US006254439B1

(12) United States Patent
Endo et al.

(10) Patent No.: US 6,254,439 B1
(45) Date of Patent: Jul. 3, 2001

(54) FEMALE TYPE TERMINAL, ASSEMBLING METHOD OF FEMALE TYPE TERMINAL, AND CONNECTOR FOR FEMALE TYPE TERMINAL

(75) Inventors: Takayoshi Endo; Kazuhisa Ishizaki; Kenichi Okamoto, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/392,218

(22) Filed: Sep. 9, 1999

(30) Foreign Application Priority Data

Sep. 10, 1998 (JP) ..... 10-256268

(51) Int. Cl.[7] ..... H01R 13/187
(52) U.S. Cl. ..... 439/843; 439/846; 439/851
(58) Field of Search ..... 439/843, 851, 439/846, 884, 825; 174/84 C

(56) References Cited

U.S. PATENT DOCUMENTS

| | | | | |
|---|---|---|---|---|
| 4,840,587 | * | 6/1989 | Lancella | 439/851 |
| 5,033,982 | * | 7/1991 | Lucas | 439/750 |
| 5,088,942 | * | 2/1992 | Welsh et al. | 439/843 |
| 5,147,221 | * | 9/1992 | Cull et al. | 439/585 |
| 5,591,039 | * | 1/1997 | Matthews | 439/181 |
| 5,667,413 | * | 9/1997 | Trafton | 439/843 |

FOREIGN PATENT DOCUMENTS

| | | |
|---|---|---|
| 6-14472 | 2/1994 | (JP) . |
| 6-19276 | 3/1994 | (JP) . |
| WO 87/05157 | 8/1987 | (WO) . |

* cited by examiner

*Primary Examiner*—Michael L. Gellner
*Assistant Examiner*—Richard K. Lee
(74) *Attorney, Agent, or Firm*—Armstrong, Westerman, Hattori, McLeland & Naughton, LLP

(57) ABSTRACT

A female type terminal for a large current, an assembling method of the female type terminal, and a connector housing for the female type terminal are provided, wherein a female type terminal includes: a male type terminal being in a rod-like shape; a female type terminal having a cylindrical terminal body in which the male type terminal is inserted, the terminal body having a large diameter portion at the end thereof; a cylindrical spring contact to be accommodated in the female type terminal and to be put into elastic-contact with the male type terminal; and a cap member having an introductory opening to introduce the male type terminal into the terminal body and having a stopping wall continuing from the introductory opening, the cap member being molded out of synthetic resin, wherein the stopping wall of the cap member is inserted into the large diameter portion and an end surface of the stopping wall abuts against the spring contact accommodated in the terminal body, whereby the spring contact is held in the terminal body.

11 Claims, 9 Drawing Sheets

1
15
14
10
10B
13
13a
12
11a
32
11
30
31

1
15
14
10
20
30
22
23
23a
22a
22b
23
20
23c
21a
21
22

1
10
10B
11
11a
12
13
13a
14
15
20
21
21a
22
22a
22b
23
23a
23c
30
31
32
L3

FEMALE TYPE TERMINAL, ASSEMBLING METHOD OF FEMALE TYPE TERMINAL, AND CONNECTOR FOR FEMALE TYPE TERMINAL

BACKGROUND OF THE INVENTION

1. Field of the Invention

The present invention generally relates to a female type terminal for a large current, an assembling method of the female type terminal, and a connector housing for the female type terminal and, more particularly to a female type terminal having a spring contact, which is put into contact with a male type terminal in a terminal body, and used for charging a battery of an electric vehicle or for connecting the battery to another apparatus, an assembling method of the female type terminal, and a connector housing to accommodate the female type terminal.

2. Description of the Related Art

As a conventional female type terminal for a large current, a female type terminal shown in FIG. 8A exists, for example.

FIG. 8A shows the female type terminal applied to an electric vehicle.

In FIG. 8A, a reference numeral 100 indicates the conventional female type terminal which has a cylindrical spring contact 120 which is put into contact with a rod-like male type terminal 200 (FIG. 8B) to be inserted in a cylindrical terminal body 110.

The terminal body 110 is formed by boring a good conductive metal, such as aluminum, and an introductory opening 111 with substantially the same diameter as the male type terminal 200 opens at the end thereof. The introductory opening 111 is tapered so as to easily insert the male type terminal 200 into the terminal body 110.

A space to receive the male type terminal 200 continues from the introductory opening 111, and an accommodating portion 110A having substantially the same diameter as the spring contact 120 is formed as a part of the space. By forming the accommodating portion 110A having a larger diameter than that of the male type terminal 200 on the way of the space, the front and rear inner walls of the accommodating portion 110A function as first and second stopping walls 112, 113 having smaller diameters than that of the spring contact 120.

On the rear of the terminal body 110 a fastening portion 110B of an electrical wire (not shown) continues.

On the other hand, the spring contact 120 has a number of arched leaf spring pieces 121 which are connected with connecting portions 122. The spring contact 120 has a cylindrical shape.

When such a spring contact 120 is accommodated in the accommodating portion 110A of the terminal body 110, the connecting portions 122 abut against an end surface 112*a* of the first stopping wall 112 and an end surface 113*a* of the second stopping wall 113, whereby the spring contact 120 is held in the accommodating portion 110A.

With respect to the above-described conventional female type terminal 100, however, since the female type terminal 100 and the male type terminal 200, being both for a large current, and large-sized and large-weighted differently from a female type terminal and a male type terminal for general and small current use, resistance, force, and shock for insertion or drawing of the male type terminal against the female type terminal is large. Despite the above, since the spring contact 120, being relatively weak and easily broken, exists in the female type terminal 100, various problems described below exist.

First, as shown in FIG. 8B, since there are an edge between the introductory opening 111 and the first stopping wall 112, i.e. the boundary 111*b*, and an end edge 112*b* of the first stopping wall 112 in the conventional female type terminal 100, the outer surface of the male type terminal 200 rubs against these edges when the male type terminal 200 is inserted aslant into or drawn aslant from the introductory opening 111, and therefore the plating on the outer surface of the male type terminal 200 would come off.

That is, since the female type terminal 100 and the male type terminal 200 for a large current are large-sized and large-weighted differently from a female type terminal and a male type terminal generally used, too large frictional resistance against the edges (the boundary 111*b* and the end edge 112*b*) of the female type terminal 100 arises when the male type terminal 200 is inserted aslant or drawn aslant, whereby the plating of the male type terminal 200 would come off.

Generally, the plating processed on a terminal improves conductivity thereof, lowers insertion and drawing resistance thereof, and further prevents the terminal from becoming rusty.

Accordingly, the coming-off of the plating on the male type terminal 200 by the insertion or drawing of the male type terminal 200, the conductivity thereof lowers, the insertion and drawing resistance of the female type terminal 100 increases, and the male type terminal 200 would become rusty.

Secondly, since the female type terminal 100 is accommodated in a terminal accommodating chamber of a connector housing (not shown) and forms a connector, the end of the male type terminal 200 inserted straight into the female type terminal 100 strikes against the leaf spring piece 121 of the spring contact 120, and in case the female type terminal 100 has been set aslant in the terminal accommodating chamber, the leaf spring piece 121 would be broken.

Thirdly, since the spring contact 120 has to pass through the introductory opening 111 and the first stopping wall 112, both having a smaller diameter than that of the spring contact 120, when the spring contact 120 is inserted into the accommodating portion 110A of the terminal body 110, the spring contact 120 has to be compressed to make the diameter smaller and, while keeping the state, is passed through the introductory opening 111 and through the first stopping wall 112, and is inserted in the accommodating portion 110A.

Therefore, the assembly work of the female type terminal would require practice and time; in other words, the assembly work could not be done efficiently.

Fourth, through the terminal body 110 of the above conventional female type terminal 100 can be formed by boring a metal, another terminal body 310 can be formed by cylindrically bending a metal plate 300 by the press work, as shown in FIGS. 9A, 9B and 9C.

Further, since the female type terminal for a large current is large-sized and large-weighted, it is characterized in having such a spring contact accommodated in the terminal body, and has the above-described problems such as coming-off of the plating of the male type terminal, breakage of the spring contact, difficulty of the assembly work, or the like, therefore, fully effective use of the cap member would be required in order to solve all of the problems.

Also, as shown in FIG. 10A, a gap L1 arises between the abutting surfaces 301,302 by "spring-back" after the press work.

And, in case that the gap L1 is larger than a width L2 of the leaf spring piece 121 of the spring contact 120, the leaf spring piece 121 of the spring contact 120 is put in the gap L1 and broken when a male type terminal (not shown) is inserted in the terminal body 310 (refer to FIG. 10B).

Further, if the pressing force is strengthened so as to prevent the gap of the abutting surfaces 301,302, the abutting surfaces 301,302 do not meet each other, which forms a wrong terminal body in dimension.

Here, Japanese Patent Application Laid-open No. 6-14472 proposes a general connector 400 having a ferrule (a cap member) 411 at the end of a female type terminal 410 as shown in FIGS. 11A, 11B, and 11C.

As shown in FIG. 11C, the ferrule 411 abuts against lances 422 when a female type terminal 410 is accommodated in a terminal accommodating chamber 421 of a connector housing 420, whereby the female type terminal 410 is prevented from shifting rearward, that is, from coming out of the terminal accommodating chamber 421.

And, the ferrule 411 guides a pin-shaped terminal 430 of the mating connector into the female type terminal 410.

With respect to the above general connector being merely equipped with the cap member at the end of the female type terminal for a large current, when the large sized and large weighted male type terminal is inserted or drawn, the cap member is apt to drop out.

Further, since the female type terminal for a large current is large-sized and large-weighted, is characterized in having such a spring contact accommodated in the terminal body, and has the above-described problems such as coming-off of the plating of the male type terminal, breakage of the spring contact, difficulty of the assembly work, or the like, therefore, fully effective use of the cap member would be required in order to solve all of the problems.

SUMMARY OF THE INVENTION

In view of the foregoing, an object of the present invention is to provide a female type terminal, an assembling method of the female type terminal, and a connector housing, wherein coming-off of the plating of a male type terminal, breakage of a spring contact, and dropping of a cap member can be prevented and simultaneously assembly work thereof can be done easily, quickly, and therefore efficiently.

In order to achieve the above-described object, as a first aspect of the present invention, a female type terminal includes: a male type terminal being in a rod-like shape; a female type terminal having a cylindrical terminal body in which the male type terminal is inserted, the terminal body having a large diameter portion at the end thereof; a cylindrical spring contact to be accommodated in the female type terminal and to be put into elastic-contact with the male type terminal; and a cap member having an introductory opening to introduce the male type terminal into the terminal body and having a stopping wall continuing from the introductory opening, the cap member being molded out of synthetic resin, wherein the stopping wall of the cap member is inserted into the large diameter portion and an end surface of the stopping wall abuts against the spring contact accommodated in the terminal body, whereby the spring contact is held in the terminal body.

According to the above-described structure, since the cap member made of synthetic resin and having the introductory opening and the stopping wall, integrally molded therewith, is attached to the end of the terminal body, even if the large-sized and large-weighted male type terminal rubs against the introductory opening or against the stopping wall when the male type terminal is inserted aslant into or drawn aslant from the introductory opening, coming-off of the plating on the outer surface of the male type terminal can be prevented. And, since the stopping wall is arranged on the cap member side, the large diameter portion having the inner diameter larger than the largest outer diameter of the spring contact can be arranged on the terminal body side. Therefore, the spring contact can be inserted into the accommodating portion of the terminal body without shrinking the spring contact radially before attaching the cap member to the terminal body.

As a second aspect of the present invention, in the structure with the above first aspect, the introductory opening of the cap member is tapered so as to guide the male type terminal into the terminal body.

According to the above-described structure, since the end of the male type terminal is guided inside the introductory opening, the male type terminal can be easily inserted into the terminal body.

As a third aspect of the present invention, in the structure with the above first aspect, the stopping wall of the cap member is formed cylindrically, an inner diameter of the stopping wall being equal to a diameter of the introductory opening of the cap member and an outer diameter thereof being substantially equal to a diameter of the large diameter portion of the terminal body.

According to the above-described structure, since the stopping wall of the cap member is in a cylindrical shape and can be inserted in the large diameter portion of the terminal body, the connection force between the cap member and the terminal body can be improved. Also, since the stopping wall of the cap member is in a cylindrical shape, an abutting area against the cylindrical spring contact can be increased and simultaneously rigidity of the stopping wall can be enhanced, thereby surely holding the spring contact.

As a fourth aspect of the present invention, in the structure with the above first aspect, an end edge of the stopping wall and a boundary between the introductory opening and the stopping wall of the cap member are rounded.

According to the above-described structure, since the boundary between the introductory opening and the first stopping wall and the end edge of the first stopping wall are both rounded, frictional resistance at the boundary and at the end edge caused by inserting or drawing the male type terminal aslant can be decreased, thereby surely preventing the plating on the male type terminal from coming off.

As a fifth aspect of the present invention, in the structure with the above first aspect, an engaging portion is provided on an outer surface of the terminal body and an outer wall is provided outside the stopping wall of the cap member with a predetermined space therebetween, the outer wall being provided with an engagement portion on an inner surface thereof to engage the engaging portion of the terminal body.

According to the above-described structure, since the engaging claw of the cap member engages the engaging convex portion or the engaging concave portion, both are tightly connected. And, by providing a plurality of engaging claws and engaging convex portions or engaging concave portions, dropping of the cap member out of the terminal body can be surely prevent.

As a sixth aspect of the present invention, in the structure with the above first aspect, an outer diameter of the cap member is substantially equal to an inner diameter of a terminal accommodating chamber of a connector housing which is to accommodate the female type terminal and further a convex contact portion having an outer diameter substantially equal to the outer diameter of the cap member is provided on the terminal body.

According to the above-described structure, since the convex contact portion of the terminal body is put into contact with the inner surface of the terminal accommodating chamber when the female type terminal is accommodated in the terminal accommodating chamber of the connector housing, inclination or ricketiness of the female type terminal can be prevented. This prevents the male type terminal inserted straight into the female type terminal from striking against the spring contact arranged in the female type terminal set aslant in the connector housing, thereby preventing breakage of the spring contact.

As a seventh aspect of the present invention, in the structure with the above first aspect, the terminal body is made of a metal plate having oppositely-arranged inclined abutting surfaces which are put into surface-contact with each other in a state that the terminal body is in a cylindrical shape.

According to the above-described structure, since the gap between the abutting surfaces does not arise when the terminal body is formed, breakage of the leaf spring piece of the spring contact accommodated in the terminal body due to bite of the leaf spring piece by the gap can be surely prevented. And, since the abutting surfaces are put into surface-contact with each other, spring-back of the edges of the terminal body can be surely prevented by applying large press-load when the terminal body is formed.

As an eighth aspect of the present invention, a female type terminal includes: a male type terminal being in a rod-like shape; a female type terminal having a terminal body cylindrically formed with a metal plate, the terminal body receiving the male type terminal; and a cylindrical spring contact to be accommodated in the female type terminal and to be put into elastic-contact with the male type terminal, wherein the metal plate has oppositely-arranged inclined abutting surfaces being put into surface-contact with each other.

According to the above-described structure, the same effects as of the seventh aspect of the present invention can be obtained.

As a ninth aspect of the present invention, an assembling method of the female type terminal according to the structure with any one of the above first to seventh aspects includes the steps of: inserting the spring contact into the terminal body through the large diameter portion without shrinking the spring contact radially; and attaching the cap member to the large diameter portion of the terminal body so as to hold the spring contact in the terminal body.

According to the above-described method, since the stopping wall is arranged on the cap member side, the large diameter portion having the inner diameter larger than the largest outer diameter of the spring contact can be arranged on the terminal body side. Therefore, the spring contact can be inserted into the accommodating portion of the terminal body without shrinking the spring contact radially before attaching the cap member to the terminal body. This enables the assembly work of the female type terminal to be done easily, quickly, and efficiently.

As a tenth aspect of the present invention, a connector housing to accommodate the female type terminal according to the structure with any one of the above fifth to seventh aspects includes: a terminal accommodating chamber whose front end communicates with an insertion opening for the male type terminal and whose rear end communicates with another insertion opening for the female type terminal; a lance provided at a front side of the terminal accommodating chamber and to abut against the end surface of the outer wall of the cap member when the female type terminal is accommodated in the terminal accommodating chamber so as to prevent the cap member from moving rearward; and a protruding wall provided at a front side of the lance and to abut against a front surface of the cap member when the lance abuts against the end surface of the outer wall of the cap member so as to prevent the cap member from moving forward.

According to the above-described structure, even if the female type terminal having the large-sized and large-weighted male type terminal therein is pulled backward, the end surface of the outer wall of the cap member abuts against the lance, thereby preventing rearward movement of the cap member. And, since the cap member and the female type terminal are tightly connected by means of the engaging claw and the engaging convex portion or the engaging concave portion, coming-out of the female type terminal from the terminal accommodating chamber of the connector housing can be prevented. Also, even if the cap member is pushed forward when the male type terminal is drawn out of the female type terminal, the front surface of the cap member abuts against the protruding wall, thereby preventing forward movement of the cap member. Consequently, dropping of the cap member from the end of the female type terminal can be prevented.

As an eleventh aspect of the present invention, in the structure with the above tenth aspect, the protruding wall is cylindrically formed so as to permit the male type terminal to go through.

According to the above-described structure, since an abutting area between the protruding wall and the cap member is increased and simultaneously rigidity of the protruding wall is enhanced, forward movement of the cap member can be surely prevented.

The above and other objects and features of the present invention will become more apparent from the following description taken in conjunction with the accompanying drawings.

DESCRIPTION OF THE PREFERRED EMBODIMENTS

Embodiments of the present invention will now be described in further detail with reference to the accompanying drawings.

Figure 1:
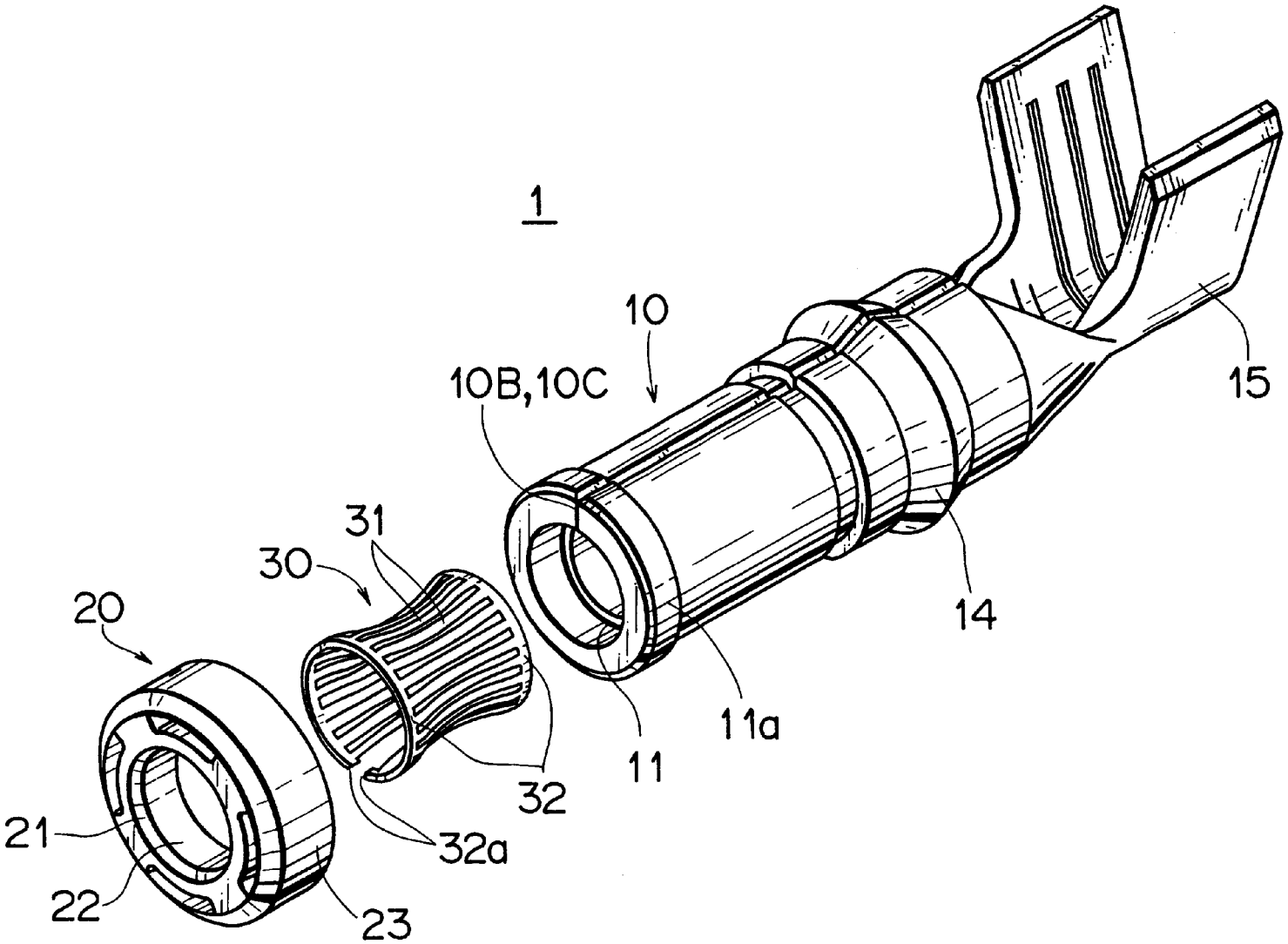
FIG. 1 is an exploded perspective view showing an embodiment of a female type terminal in accordance with the present invention.
Figures 2, 3:
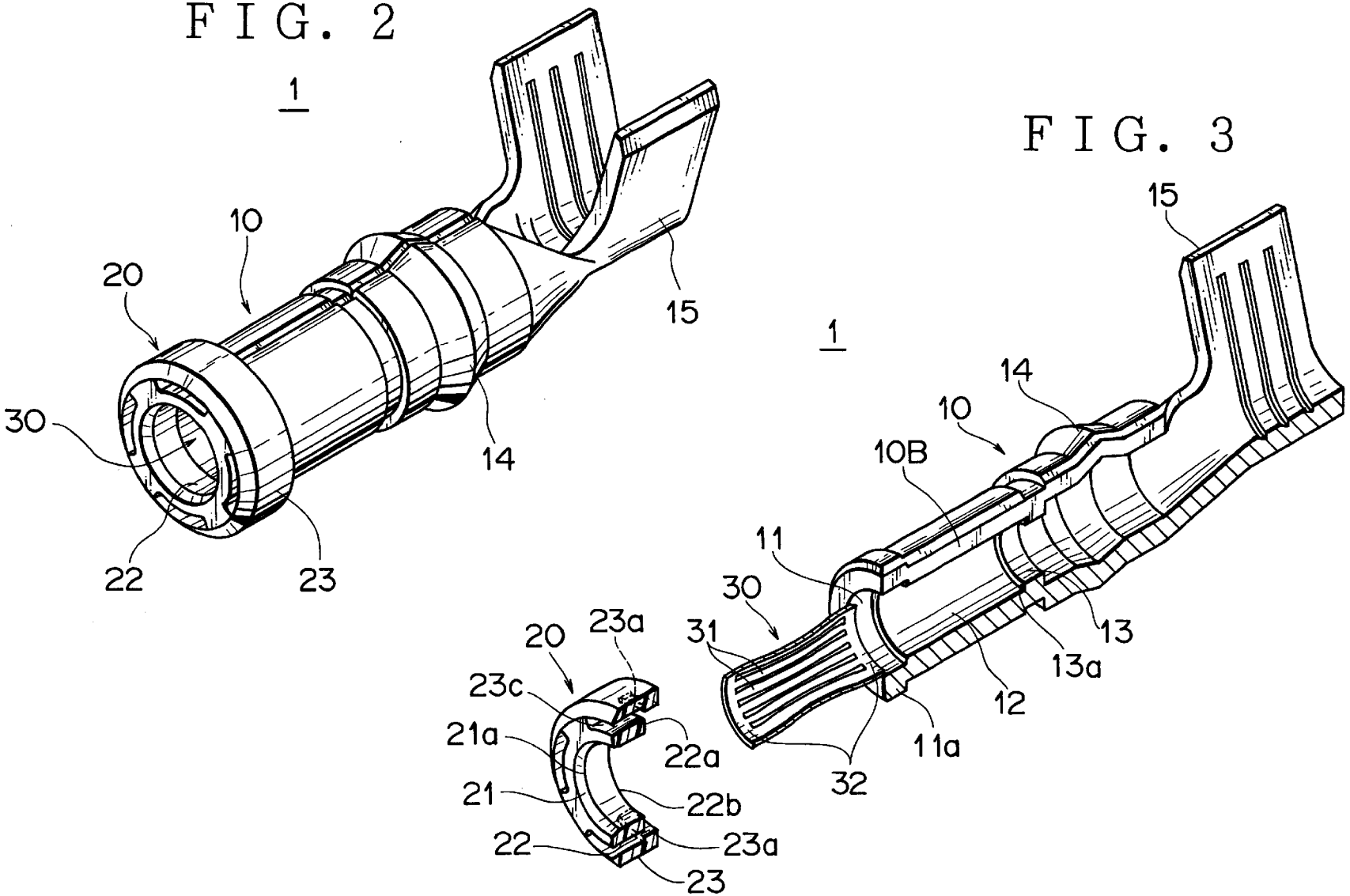
FIG. 2 is a perspective view of the female type terminal of FIG. 1 in an assembled state.
FIG. 3 is an exploded perspective sectional view of the female type terminal of FIG. 1.

FIG. 1 is an exploded perspective view showing an embodiment of a female type terminal in accordance with the present invention, and FIG. 2 is a perspective view of the female type terminal of FIG. 1 in an assembled state.

In FIGS. 1 and 2, a reference numeral 1 indicates a female type terminal in accordance with the present embodiment, which female type terminal consists of a terminal body 10, a cap member 20, and a spring contact 30.

The terminal body 10 and the spring contact 30 are formed by pressing a metal plate, and the cap member 20 is made of synthetic resin.

Figures 4A, 4B, 4C:
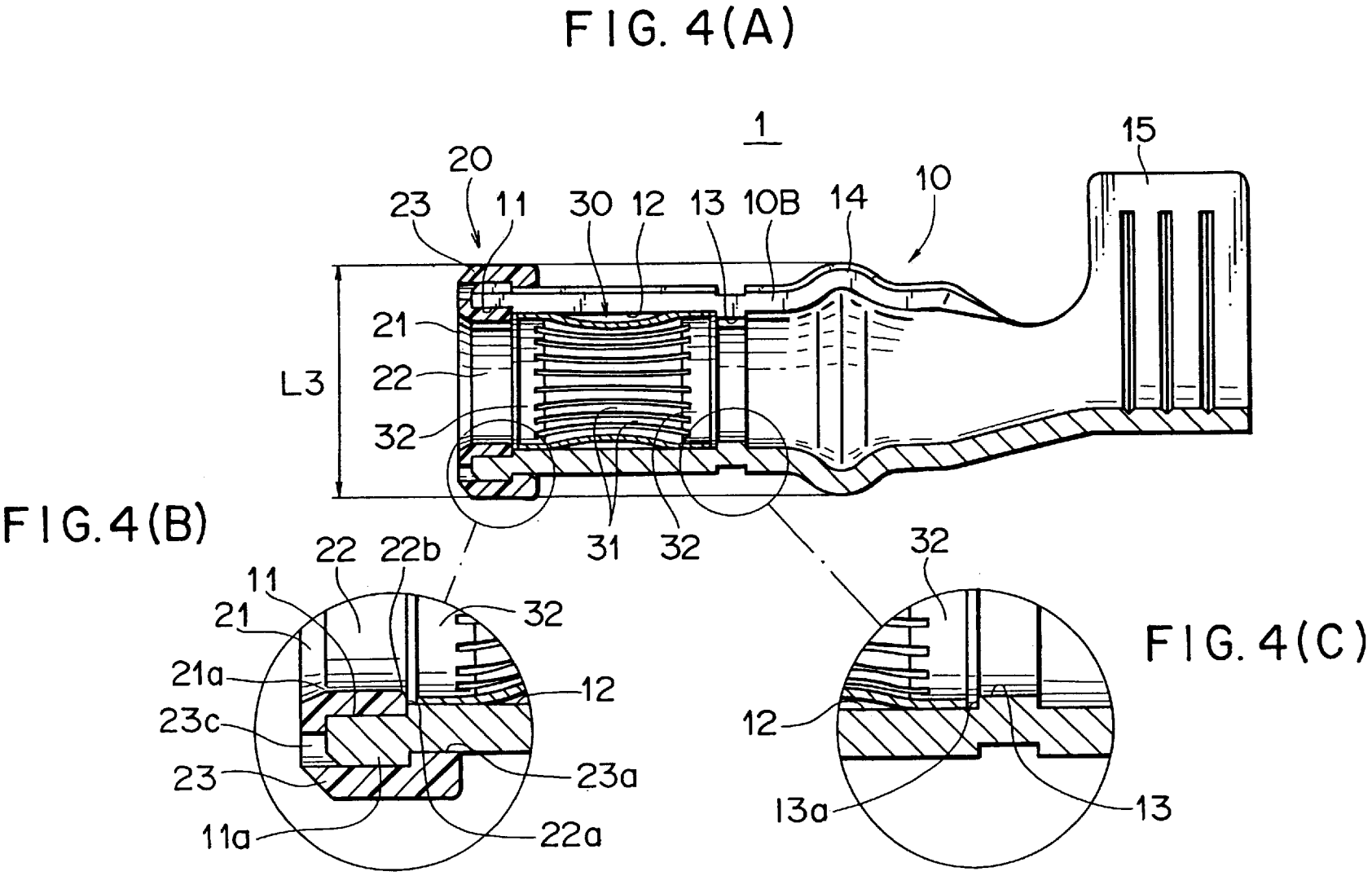
FIG. 4A is a sectional view of the female type terminal in an assembled state and FIGS. 4B and 4C are enlarged partial views of selected regions of the terminal.

Next, the terminal body 10 and the cap member 20 are described in detail referring to FIGS. 3 and 4.

The spring contact 30 has a number of arched leaf spring pieces 31 which are connected with connecting portions 32, which spring contact 30 is in a cylindrical shape. Since structure of the spring contact 30 is basically the same as of the conventional one, then detailed description is omitted hereinafter.

First, description is made for the terminal body 10.

The terminal body 10 is in a cylindrical shape and has a large diameter portion 11, an accommodating portion 12, a second stopping wall 13, a convex contact portion 14, and a fastening portion 15 from the end thereof.

The large diameter portion 11 is formed at the end of the terminal body 10 and has a larger inner diameter than the largest outer diameter of the spring contact 30, that is, an outer diameter of the connecting portion 32 in a contact-state of both ends 32*a* thereof shown in FIG. 1.

The depth of the large diameter portion 11 is substantially the same as a height of a first stopping wall 22 (described later) of the cap member 20, and the large diameter portion 11 has an engaging enlarged head portion 11*a* providing a shoulder which engages an engaging claim 23*a* (described later) of the cap member 20.

The accommodating portion 12 has an inner diameter substantially equal to the largest outer diameter of the spring contact 30 and accommodates the spring contact 30.

The radial depth of the accommodating portion 12 is a little greater than the span of the spring contact 30, which permits the spring contact 30 to extend when a male type terminal (not shown) is inserted therein.

The second stopping wall 13 has a smaller inner diameter than the largest outer diameter of the spring contact 30 and prevents the spring contact 30 from moving rearward by abutting an end surface 13*a* thereof against the connecting portion 32 of the spring contact 30.

The convex contact portion 14 is formed on the terminal body 10 in a circumferential direction thereof and has substantially the same outer diameter as that of the cap member 20.

Figure 7:
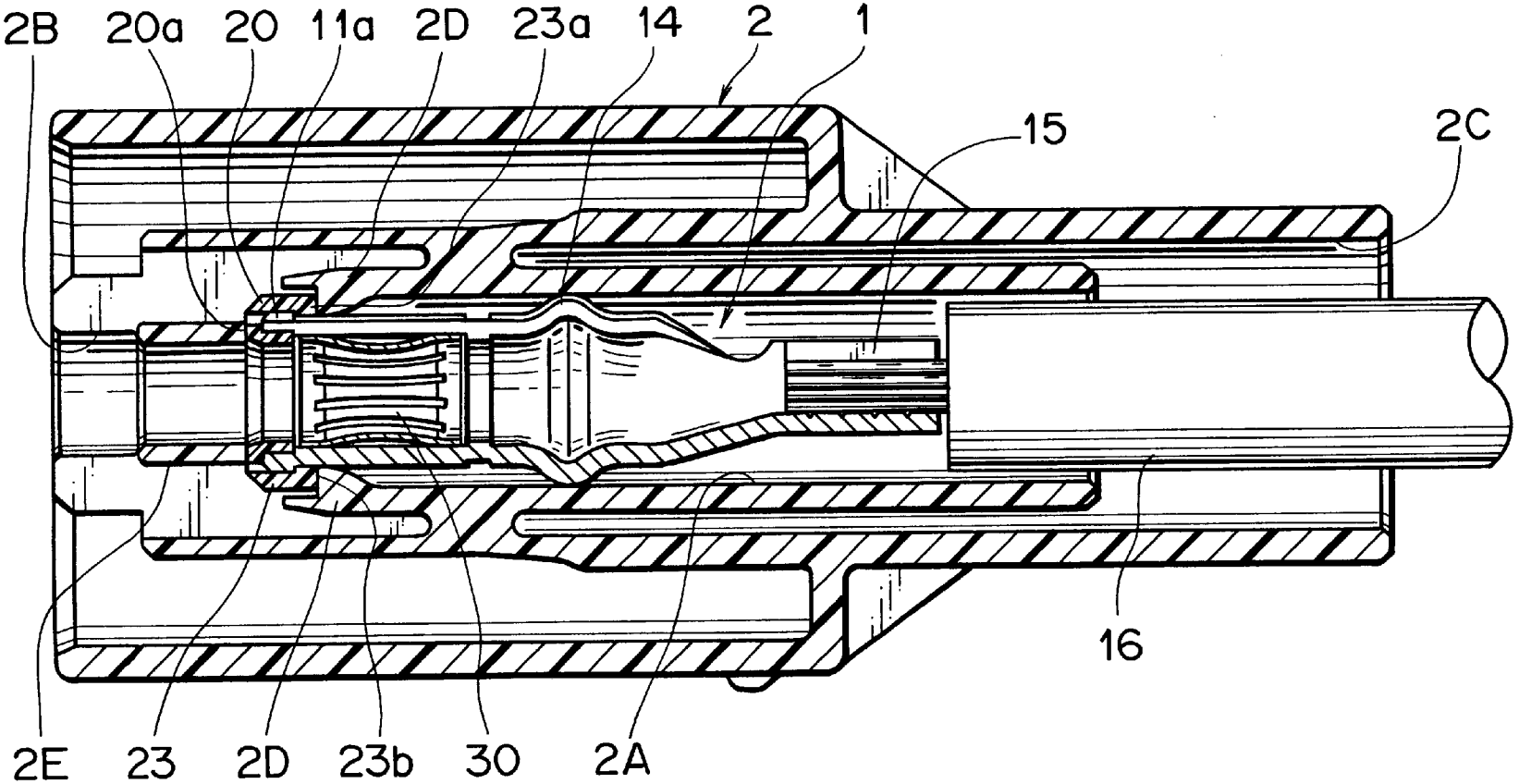
FIG. 7 is a sectional view showing an embodiment of a connector housing in accordance with the present invention.
Figure 8A:
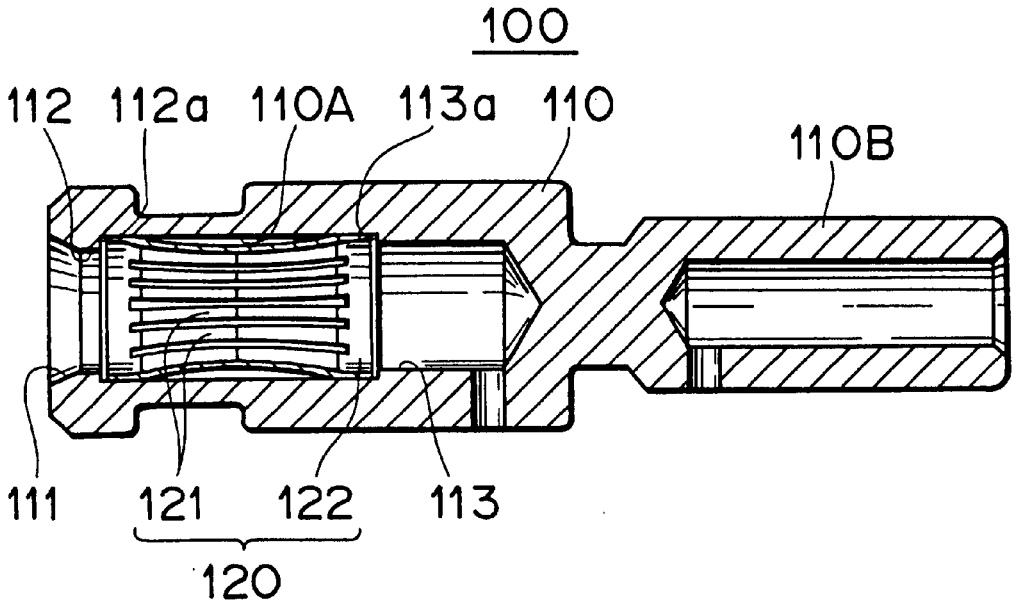
FIG. 8A PRIOR ART
FIG. 8A is a sectional view showing a conventional female type terminal for a large current applied to an electric vehicle.
Figure 8B:
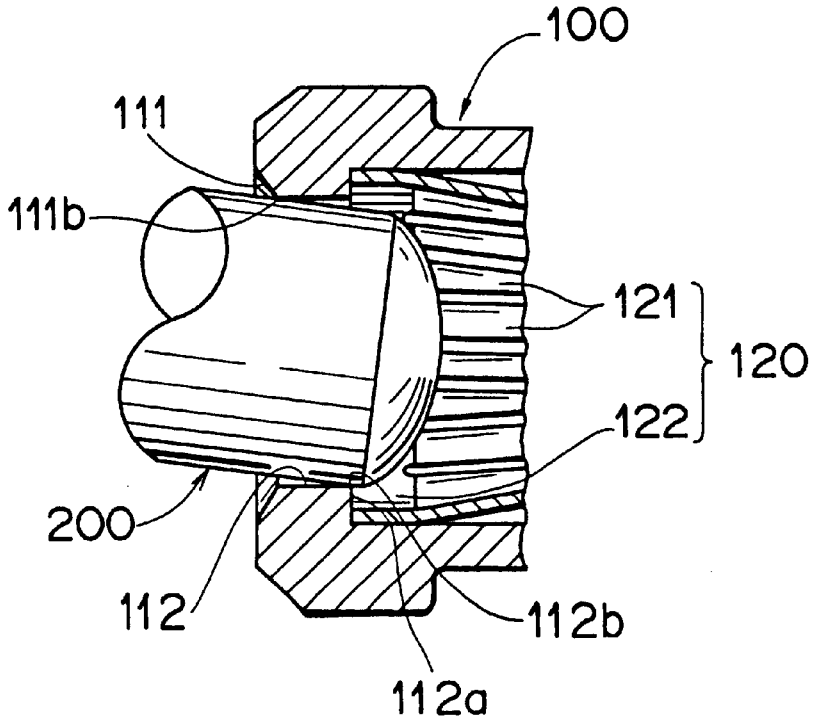
FIG. 8B PRIOR ART
FIG. 8B is a partly enlarged sectional view of FIG. 8A.
Figure 9A:
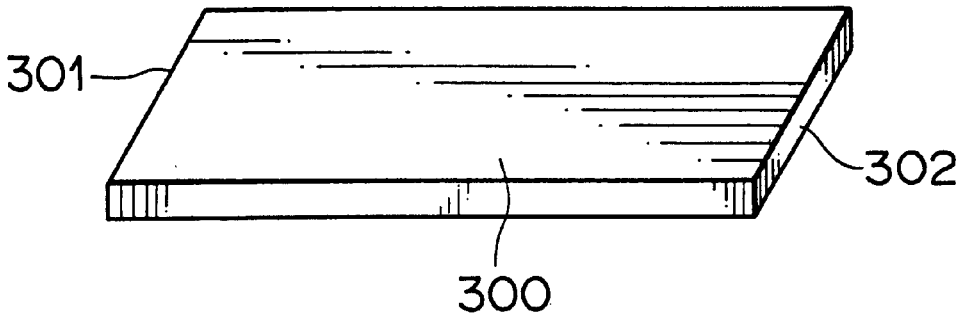
FIG. 9A PRIOR ART
FIGS. 9A, 9B, and 9C show a process of the press work to form a terminal body of the conventional female type terminal.
Figure 9B:
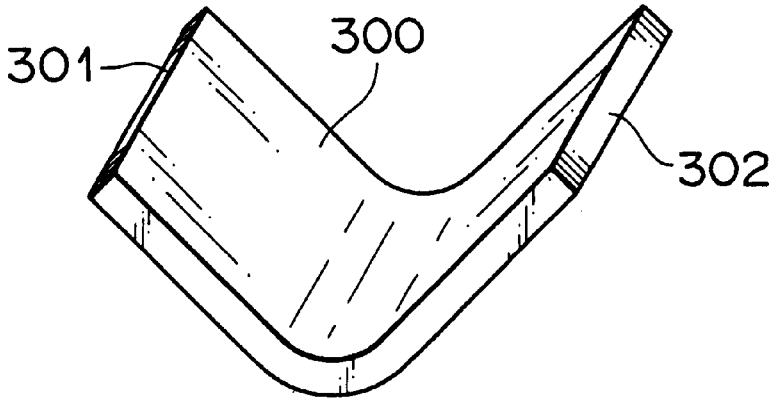
FIG. 9B PRIOR ART
Figure 9C:
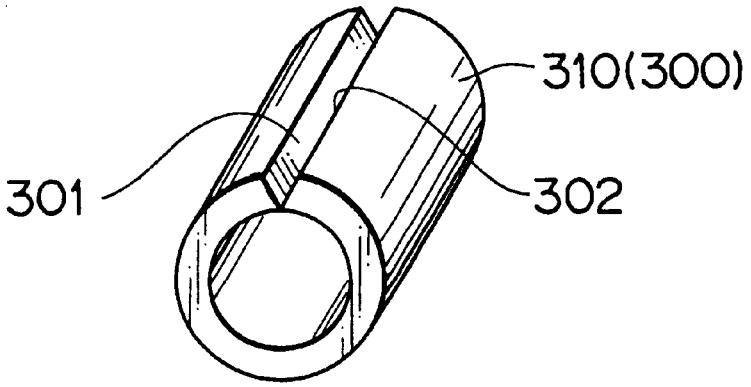
FIG. 9C PRIOR ART
Figure 11A:
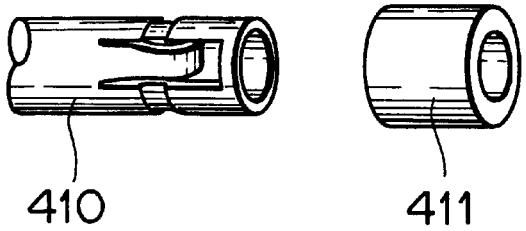
FIG. 11A PRIOR ART
FIG. 11A is a partly enlarged view of the prior art female type terminal to be equipped with a cap member.
Figure 11B:
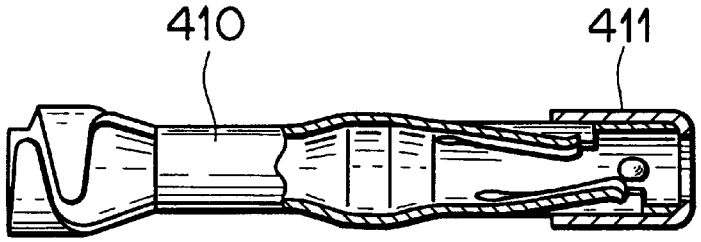
FIG. 11B PRIOR ART
FIG. 11B is a sectional view of the female type terminal of FIG. 11A to which the cap member is attached.
Figure 11C:
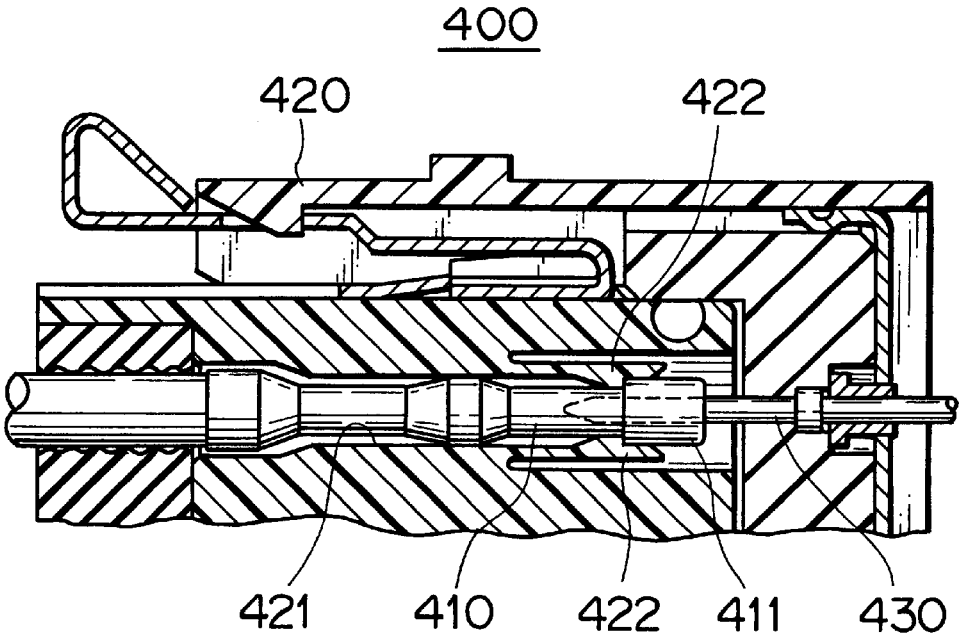
FIG. 11C PRIOR ART
FIG. 11C is a sectional view of a connector housing accommodating the female type terminal of FIG. 11B.

The fastening portion 15 is bent inwardly by a jig (not shown) for crimping an electrical wire 16 as shown in FIG. 7.

Figure 5A:
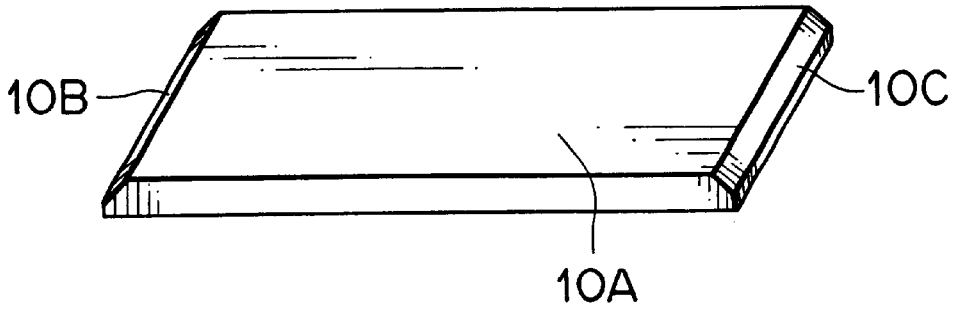
FIGS. 5A–5C show process of the press work to form a terminal body of the female type terminal.
Figure 5B:
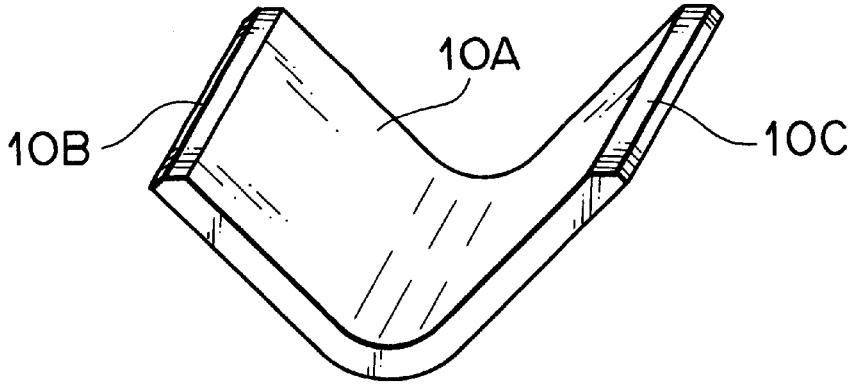
Figure 5C:
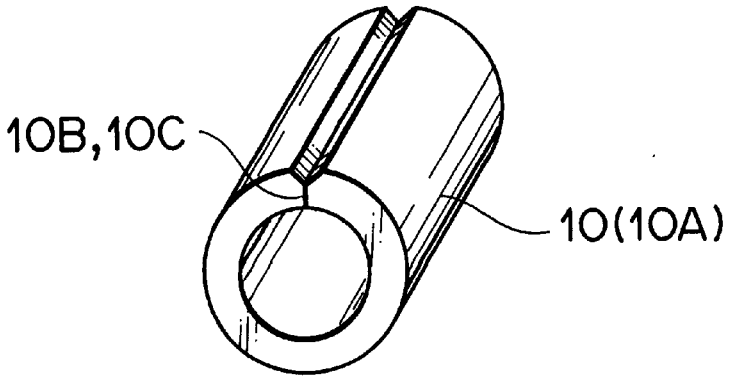
Figure 6:
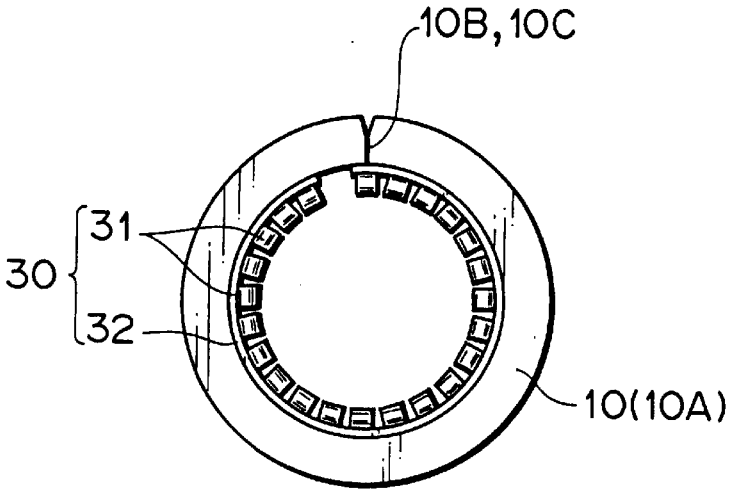
FIG. 6 is a cross-sectional view of the terminal body, shown in FIG. 5C, accommodating the spring contact therein.
Figure 10A:
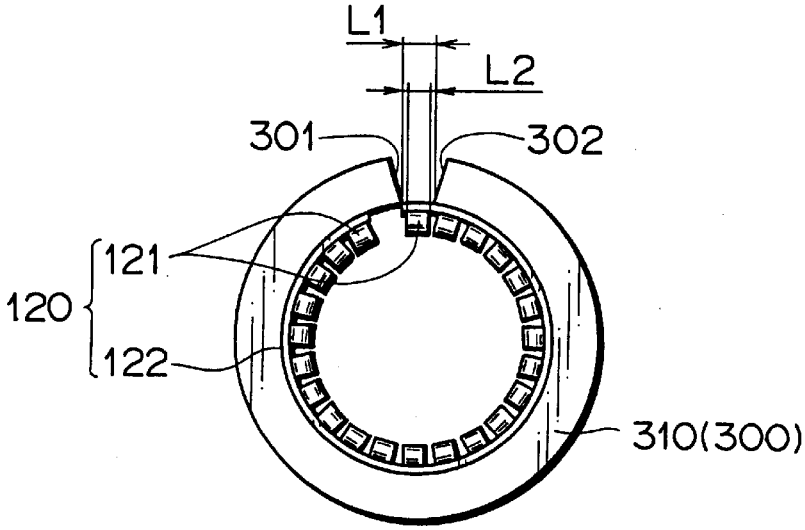
FIG. 10A PRIOR ART
FIGS. 10A and 10B are cross-sectional views of the terminal body, shown in FIG. 9C, accommodating the spring contact therein.
Figure 10B:
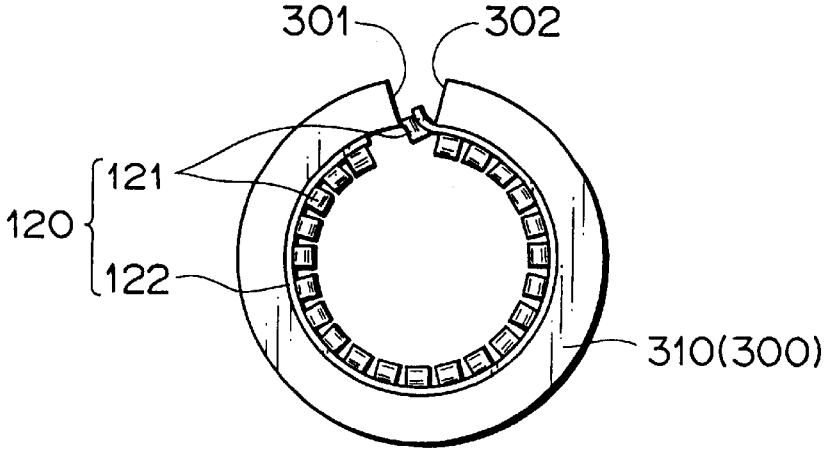
FIG. 10B PRIOR ART

The terminal body 10 with the above structure is formed by pressing a metal plate 10A cylindrically as shown in FIGS. 5A–5C.

Here, the opposite edges of the metal plate 10A for the terminal body 10 are provided with respective inclined abutting surfaces 10B,10C by chamfering.

Each of the abutting surfaces 10B,10C has an inclined angle so as not to make a space therebetween when the metal plate 10A is cylindrically formed as shown in FIGS. 5C,3, and 4. And, the inclined angle is decided in accordance with thickness and curvature of the metal plate 10A.

The provision of the inclined abutting surfaces 10B,10C puts them into surface-contact with each other when the metal plate 10A is formed cylindrically.

Next, referring back to FIGS. 3 and 4, the cap member 20 is described.

The cap member 20 mainly consists of an introductory opening 21, the first stopping wall 22, and an outer wall 23, which are integrally molded from synthetic resin The introductory opening 21 has substantially the same diameter as that of the male type terminal. After attaching the cap member 20 to the end portion of the terminal body 10, the male type terminal is inserted into the terminal body 10 through the introductory opening 21.

And, since the introductory opening 21 is tapered, the male type terminal is easily guided into the terminal body 10 through the introductory opening 21.

The first stopping wall 22 is formed continuously about the introductory opening 21, has the same inner diameter as the introductory opening 21 at the least-diameter end of the taper, and further has substantially the same outer diameter as the inner diameter of the large diameter portion 11 of the terminal body 10.

The first stopping wall 22 is inserted inside the large diameter portion 11 of the terminal body 10 when the cap member 20 is attached to the end of the terminal body 10.

The connecting portions 32 of the spring contact 30 accommodated in the accommodating portion 12 abut against an end surface 22*a* of the first stopping wall 22 and the spring contact 30 is prevented from moving forward.

Here, the boundary 21*a* between the introductory opening 21 and the first stopping wall 22 and an end edge 22*b* of the first stopping wall 22 are both rounded, taking in consideration of damage of the male type terminal to be inserted into the introductory opening 21.

The outer wall 23 is molded integrally with the first stopping wall 22 and is arranged in concentrically spaced relation outside the first stopping wall 22 with a gap 23*c* having the same width as a thickness of the large diameter portion 11.

And, on the inner surface of the outer wall 23, a plurality of engaging claws 23*a* to engage the engaging convex portion 11*a* of the terminal body 10 are projectingly arranged at even intervals.

Next, an assembling method of the present embodiment of the female type terminal in accordance with the present invention is described.

In FIG. 1, firstly, the ends 32*a* of the connecting portion 32 of the spring contact 30 are put into contact with each other, and the spring contact 30 is inserted in the accommodating portion 12 without changing the diameter thereof.

As shown in FIGS. 2 and 4, the cap member 20 is attached to the end of the terminal body 10 with inserting the first stopping wall 22 of the cap member 20 into the large diameter portion 11 of the terminal body 10.

Then, as shown in FIGS. 3 and 4, the end surface 22*a* of the first stopping wall 22 abuts against the connecting portion 32 of the spring contact 30, whereby the spring contact 30 is held in the accommodating chamber 12.

And, simultaneously with the above, the engaging claws 23*a* of the outer wall 23 engage the engaging convex portion 11*a* of the large diameter portion 11, and the cap member 20 is tightly connected to the terminal body 10.

As described above, since the first stopping wall 22 is provided on the cap member 20, the end of the terminal body 10 is formed as the large diameter portion 11 having a larger diameter than that of the largest outer diameter of the spring contact 30.

Therefore, in the assembling method of the present embodiment of the female type terminal, since the spring contact 30 is inserted into the terminal body 10 before attaching the cap member 20 thereto, the spring contact 30 can be inserted into the accommodating portion 12 of the terminal body 10 without shrinking the spring contact 30 radially.

Next, an embodiment of a connector housing in accordance with the present invention is described.

FIG. 7 is a sectional view showing the embodiment of the connector housing.

The connector housing 2 of the present embodiment shown in FIG. 7 accommodates the above-described female type terminal 1 to thereby form a connector and is integrally molded from synthetic resin.

Inside the connector housing 2, a terminal accommodating chamber 2A having an inner diameter substantially equal to the outer diameter of the cap member 20 of the female type terminal 1 is formed.

The front end of the terminal accommodating chamber 2A communicates with an insertion opening 2B for the above-described male type terminal and the rear end thereof communicates with an insertion opening 2C for the female type terminal 1.

At the front side of the terminal accommodating chamber 2A, a pair of resilient lances 2D are integrally molded therewith.

The lances 2D abut against the end surface 23*b* of the outer wall 23 of the cap member 20 when the female type terminal 1 is accommodated in the terminal accommodating chamber 2A, whereby rearward movement of the female type terminal 1 is prevented.

Ahead of the lances 2D, a cylindrical protruding wall 2E capable of putting the male type terminal therethrough is integrally molded with the terminal accommodating chamber 2A.

The protruding wall 2E abuts against the front surface 20*a* of the cap member 20 when the lances 2D abut against the end surface 23*b* of the outer wall 23 of the cap member 20, whereby forward movement of the female type terminal 1 is prevented.

Although the present invention has been fully described by way of examples with reference to the accompanying drawings, it is to be noted that various changes and modifications will be apparent to those skilled in the art. For example, the female type terminal having a terminal body made by boring a metal rod may be used. Therefore, unless otherwise such changes and modifications depart from the scope of the present invention, they should be construed as being included therein.

What is claimed is:

1. A female type terminal for receiving a male type terminal having a rod-like shape, said female type terminal comprising:

a cylindrical terminal body for receiving said male type terminal, said terminal body having an accommodating portion and a portion of a diameter larger than that of said accommodating portion of said terminal body at an end of said terminal body, said larger diameter portion being separated from said accommodating portion by a step-like end surface;

a cylindrical spring contact accommodated in said accommodating portion and having spring pieces to be put into elastic-contact with said male type terminal, when said male type terminal is inserted into said terminal body; and a cap member formed of synthetic resin and having an introductory opening to introduce said male type terminal into said terminal body, said cap member enclosing said larger diameter portion of said terminal body and having a stopping wall continuing from said introductory opening, wherein, when said stopping wall of said cap member is installed on said larger diameter portion of said terminal body, an end surface of said stopping wall abuts against said spring contact accommodated in said terminal body, whereby said spring contact is held in said terminal body.

2. The female type terminal according to claim 1, wherein said introductory opening of said cap member is tapered so as to guide said male type terminal into said terminal body.

3. The female type terminal according to claim 1, wherein said stopping wall of said cap member is formed cylindrically, an inner diameter of said stopping wall being equal to a diameter of said introductory opening of said cap member and an outer diameter of said stopping wall being substantially equal to a diameter of said larger diameter portion of said terminal body.

4. The female type terminal according to claim 1, wherein an end edge of said stopping wall and a boundary between said introductory opening and said stopping wall of said cap member are rounded.

5. The female type terminal according to claim 1, wherein a step-like engaging portion is provided on an outer surface of said terminal body and an outerwall is provided outside said stopping wall of said cap member, said outer wall of said stopping wall being provided with a step-like engagement portion on an inner surface thereof engaging said step-like engaging portion of said terminal body.

6. The female type terminal according to claim 1, wherein an outer diameter of said cap member is substantially equal to an inner diameter of a terminal accommodating chamber of a connector housing which is to accommodate said female type terminal and further a convex contact portion having an outer diameter substantially equal to said outer diameter of said cap member is provided on said terminal body.

7. The female type terminal according to claim 1, wherein said terminal body is made of a metal plate having oppositely-arranged inclined abutting surfaces which are put into surface-contact with each other in a state that said terminal body is in a cylindrical shape.

8. An assembling method of the female type terminal according to any one of claims 1–7, comprising the steps of:

inserting said spring contact into said accommodating portion of said terminal body through said larger diameter portion without shrinking said spring contact radially; and attaching said cap member to said larger diameter portion of said terminal body wherein an end of said stopping wall of said cap member engages said spring contact to hold said spring contact in said terminal body.

9. A connector housing to accommodate the female type terminal according to any one of claims 5–7, comprising:

a terminal accommodating chamber whose front end communicates with an insertion opening for said male type terminal and whose rear end communicates with another insertion opening for said female type terminal;

a lance provided at a front side of said terminal accommodating chamber and to abut against said end surface of said outer wall of said cap member when said female type terminal is accommodated in said terminal accommodating chamber so as to prevent said cap member from moving rearward; and a protruding wall provided at a front side of said lance and to abut against a front surface of said cap member when said lance abuts against said end surface of said outer wall of said cap member so as to prevent said cap member from moving forward.

10. The connector housing according to claim 9, wherein said protruding wall is cylindrically formed so as to permit said male type terminal to go through.

11. A female type terminal for receiving a male type terminal having a rod-like shape, comprising:

a terminal body cylindrically formed from a metal plate, said terminal body receiving said male type terminal; and a cylindrical spring contact accommodated in said terminal body to be put into elastic-contact with said male type terminal, wherein said metal plate has oppositely-arranged inclined abutting surfaces which are put into surface-contact with each other when said metal plate is placed in a cylindrical condition.

* * * * *